US012714932B2

(12) United States Patent
Mouchet

(10) Patent No.: US 12,714,932 B2
(45) Date of Patent: Aug. 25, 2026

(54) SKATING RINK THAT RETAINS REFRIGERATION ENERGY BY WAY OF A PHASE-CHANGE MATERIAL

(71) Applicant: SUN-ICE ENERGY PTE. LTD., Singapore (SG)

(72) Inventor: Jacques Mouchet, Les Clayes-sous-bois (FR)

(73) Assignee: SUN-ICE ENERGY PTE. LTD., Singapore (SG)

( * ) Notice: Subject to any disclaimer, the term of this patent is extended or adjusted under 35 U.S.C. 154(b) by 178 days.

(21) Appl. No.: 18/287,167

(22) PCT Filed: Apr. 15, 2022

(86) PCT No.: PCT/IB2022/053572
§ 371 (c)(1),
(2) Date: Nov. 7, 2023

(87) PCT Pub. No.: WO2022/219602
PCT Pub. Date: Oct. 20, 2022

(65) Prior Publication Data

US 2024/0207714 A1 Jun. 27, 2024

(30) Foreign Application Priority Data

Apr. 16, 2021 (FR) ..... 2103962

(51) Int. Cl.
*A63C 19/10* (2006.01)
*F25C 3/02* (2006.01)

(52) U.S. Cl.
CPC ..... *A63C 19/10* (2013.01); *F25C 3/02* (2013.01)

(58) Field of Classification Search
CPC . A63C 19/10; F25C 3/02; Y02E 60/14; F25B 39/02
(Continued)

(56) References Cited

U.S. PATENT DOCUMENTS 1,810,926 A * 6/1931 Palson ..... F25C 3/02 62/235
1,883,958 A * 10/1932 Koeniger ..... E01C 13/105 62/235
(Continued)

FOREIGN PATENT DOCUMENTS

CN 205223791 U 5/2016
CN 106320138 A 1/2017
(Continued)

OTHER PUBLICATIONS

CN-109595859-A, machine translation (Year: 2025).*
(Continued)

*Primary Examiner* — Eric S Ruppert
*Assistant Examiner* — Kirstin U Oswald
(74) *Attorney, Agent, or Firm* — Cognition IP, P.C.; Edward Steakley

(57) ABSTRACT

The present invention relates to a covered artificial skating rink (1) made up of a closed building built over a slab (5) intended to be covered with ice, characterised in that the skating rink (1) comprises:

Figure 1:
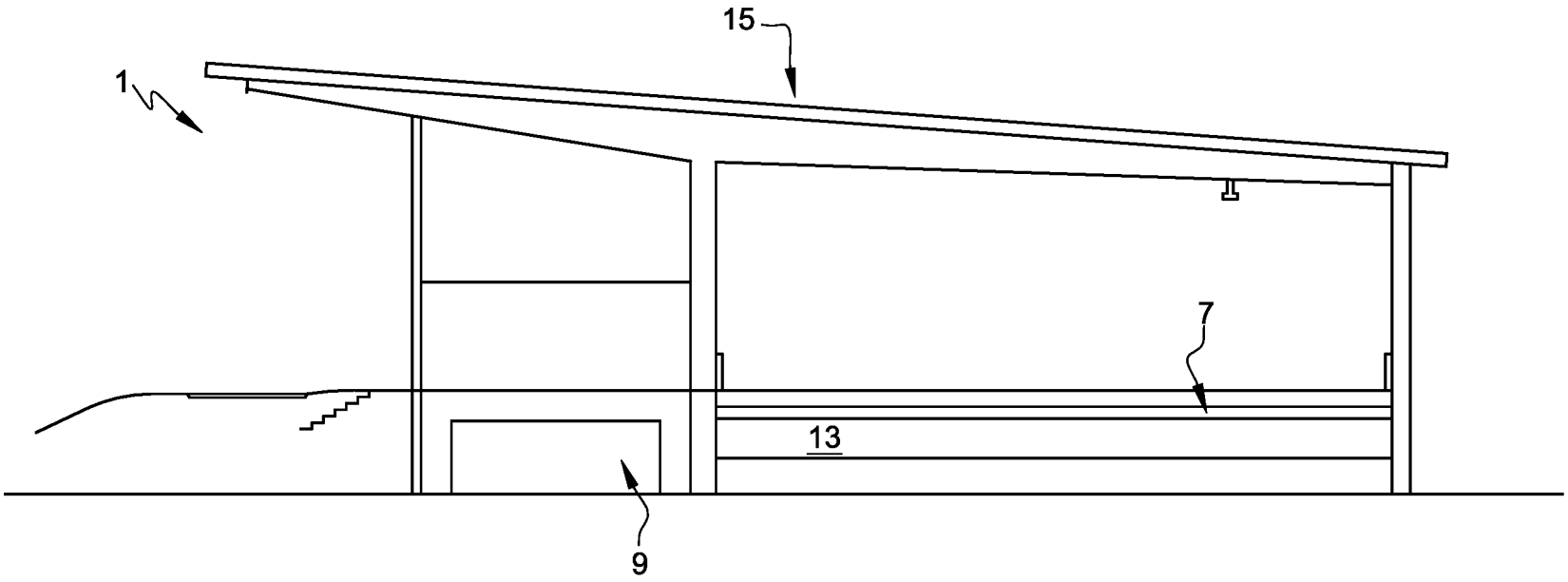

a refrigeration device (9) connected to a refrigerant network (11) in which a refrigerant fluid circulates;

a phase-change material (13) connected to said refrigeration device (9) via the refrigerant network;

the phase-change material (13) being configured to keep the ice (7) covering the slab at a temperature below the melting temperature of the ice.

13 Claims, 3 Drawing Sheets

(58) Field of Classification Search
USPC ..... 62/235
See application file for complete search history.

(56) References Cited

U.S. PATENT DOCUMENTS

| | | | | | |
|---|---|---|---|---|---|
| 1,917,634 | A * | 7/1933 | Carpenter | F25C 3/02 | 62/235 |
| 1,968,144 | A * | 7/1934 | Hamilton | F25C 3/02 | 62/235 |
| 2,026,052 | A * | 12/1935 | Macleod | E01C 13/105 | 62/235 |
| 2,066,656 | A * | 1/1937 | Stromberg | E01C 13/105 | 165/56 |
| 2,301,780 | A * | 11/1942 | Heinzelman | E01C 13/105 | 62/331 |
| 2,878,651 | A * | 3/1959 | Heinzelman | E01C 13/105 | 165/56 |
| 2,955,437 | A * | 10/1960 | Nilsson | E01C 13/105 | 62/235 |
| 3,641,782 | A * | 2/1972 | Timms | F25C 3/02 | 62/177 |
| 3,668,885 | A * | 6/1972 | Kuebler | E01C 13/105 | 62/235 |
| 3,721,418 | A * | 3/1973 | Vincent | E01C 13/102 | 62/235 |
| 3,751,935 | A * | 8/1973 | MacCracken | F25C 3/02 | 62/235 |
| 3,815,901 | A * | 6/1974 | Wiig | F25C 3/04 | 62/235 |
| 3,827,253 | A * | 8/1974 | Williams | F25C 3/02 | 62/235 |
| 3,898,855 | A * | 8/1975 | Curfhey | E01C 13/102 | 62/235 |
| 3,910,059 | A * | 10/1975 | MacCracken | E01C 13/105 | 62/99 |
| 3,919,858 | A * | 11/1975 | Garland | F28F 9/0263 | 62/235 |
| 4,235,221 | A * | 11/1980 | Murphy | H02S 40/44 | 126/609 |
| 4,294,078 | A * | 10/1981 | MacCracken | F28D 20/021 | 126/618 |
| 4,367,633 | A * | 1/1983 | Strathman | F25B 49/02 | 62/235.1 |
| 4,594,859 | A * | 6/1986 | Ohashi | E01C 13/105 | 62/235 |
| 4,667,481 | A * | 5/1987 | Watanabe | A63C 19/00 | 62/235 |
| 5,331,826 | A * | 7/1994 | Stockhaus | A63C 19/10 | 62/235 |
| 6,089,035 | A * | 7/2000 | Mildengren | A63C 19/10 | 62/235 |
| 6,170,278 | B1 * | 1/2001 | Jorgensen | F25C 3/02 | 62/235 |
| 2005/0066677 | A1 * | 3/2005 | Beynon | A63C 19/10 | 62/235 |
| 2005/0188710 | A1 * | 9/2005 | Dilk | F25B 9/002 | 62/235 |
| 2008/0006051 | A1 * | 1/2008 | Johnson | B67D 1/0857 | 62/465 |
| 2011/0172832 | A1 * | 7/2011 | Kirby | F24F 5/0046 | 700/278 |
| 2013/0055745 | A1 * | 3/2013 | Fukuoka | F25C 3/02 | 62/235 |
| 2016/0320098 | A1 * | 11/2016 | Lesmerises | F25B 43/02 | |
| 2018/0299605 | A1 * | 10/2018 | Keating | G02B 6/001 | |

FOREIGN PATENT DOCUMENTS

| | | | | | |
|---|---|---|---|---|---|
| CN | 109595859 | A * | 4/2019 | F25D 23/065 | |
| CN | 209443331 | U * | 9/2019 | | |
| DE | 4443403 | A1 * | 6/1996 | E01C 13/105 | |
| DE | 102018002009 | A1 * | 10/2018 | B65D 88/12 | |
| EP | 0168504 | A1 * | 1/1986 | E01C 7/265 | |
| GB | 2415243 | A | 12/2005 | | |
| JP | H0735452 | A * | 2/1995 | | |
| JP | 2002276142 | A * | 9/2002 | | |

OTHER PUBLICATIONS

Jp H0735452 A, machine translation (Year: 2025).*
DE-102018002009-A1, machine translation (Year: 2025).*
CN-209443331-U, machine translation (Year: 2025).*
JP-2002276142-A, machine translation (Year: 2025).*
EP-0168504-A1, machine translation (Year: 2025).*
DE-4443403-A1, machine translation (Year: 2025).*
International Search Report and Written Opinion in International Application No. PCT/IB2022/053572, mailed on Aug. 1, 2022.

* cited by examiner

SKATING RINK THAT RETAINS REFRIGERATION ENERGY BY WAY OF A PHASE-CHANGE MATERIAL

CROSS-REFERENCE TO RELATED APPLICATIONS

This application is a 35 U.S.C. § 371 U.S. National Stage application of International Application No. PCT/IB2022/053572, filed on Apr. 15, 2022, which claims the benefit of priority of French Application No. FR2103962, filed on Apr. 16, 2021, which are incorporated herein by reference in their entirety.

The present invention relates to a covered artificial skating rink comprising a closed building, such as a tent or a dome built over a slab intended to be covered with ice. Said slab intended to be covered with ice (frozen water) thus allows the practice of any type of winter sport, such as skating, curling, ice hockey, etc.

Several types of artificial skating rinks are known that have slabs, made of various materials, comprising refrigeration devices in order to sufficiently cool water spread on the slab surface to turn it into ice.

In some known embodiments, such slabs comprise a layer incorporating channels for circulating a refrigerant fluid, such as a liquid coolant, disposed in a network and connected to a refrigerating set which circulates a liquid refrigerant in said circulation channels.

In order to limit the inevitable cooling losses created by refrigerating sets, it is known to thermally insulate the slab by providing to dispose, between the latter and the primary floor, a layer of thermal insulation. The absence of such a layer of thermal insulation results in substantial heat losses. In some cases, hot water is run under this insulating layer to prevent the primary floor from freezing.

However, despite these measures, the artificial skating rinks known in the prior art are characterised by substantial heat losses requiring the continuous operation, i.e. day and night, of high-power and, hence, costly refrigeration sets. Furthermore, it is difficult to keep the ice in good condition since the top surface thereof is in contact with the ambient air of the skating rink, which is often humid, on account of the presence of skaters and the public.

Moreover, ice skating and its derivatives (hockey, figure skating, etc.) are increasingly popular activities and an increase in the number of skating rinks built can be observed worldwide, more specifically in certain countries in Asia.

Unfortunately, as mentioned above, a skating rink requires a substantial quantity of continuous energy to keep a large quantity of water in ice form, so that people can skate under good conditions.

This energy consumption is especially substantial in countries having hot and/or tropical climates, wherein outdoor temperatures are usually greater than 20° C. and rarely below 0° C.

One of the aims of the present invention is hence that of remedying the drawbacks cited above, and of providing a covered artificial skating rink making it possible in particular to make use for example of a solar panel array for storing the energy produced in the daytime to maintain ice quality at night, in order to retain ice of constant quality over the entire skating surface, and which has a simple and reliable design, with a relatively moderate running cost, particularly more economical in terms of the energy consumption thereof.

The present invention also covers the use of phase-change materials incorporated in a reserve external to the skating rink floor.

Thus, the present invention makes it possible to create a novel type of skating rink using intermittent energy sources, for example solar panels.

Said invention is therefore a covered artificial skating rink composed of a closed building built over a slab intended to be covered with ice, characterised in that the skating rink comprises:

- a refrigeration device connected to a refrigerant network wherein a refrigerant fluid circulates;
- a phase-change material connected to the refrigeration device via said refrigerant network;

said phase-change material being configured to keep the ice covering the slab at a temperature below the melting point of the ice.

The present invention proposes to dispose the slab of the skating rink on an additional layer incorporating phase-change materials serving as a "refrigeration reserve" to help maintain the quality of the layer of ice for a sufficient time, particularly to allow the shutdown of the compressors of the refrigeration device at night.

It will be noted that phase-change material (or PCM) denotes any material capable of changing physical state within a restricted, preferably negative, temperature range, for example around −15 degrees Celsius.

It will be noted that refrigerant fluid (or coolant) denotes a fluid allowing the implementation of a refrigeration cycle. Said fluid can be pure or be a mixture of fluids in liquid, gas phase or both according to the temperature and pressure conditions. The fluid advantageously absorbs heat at low temperature and low pressure, then releases heat at a higher temperature and pressure, for example upon a change of physical state.

According to another possible feature, the phase-change material(s) can be contained in tanks placed under the slab with an "expansion space" making it possible to withstand, without noteworthy deformation, the change of volume following the phase change.

According to another possible feature, cooling of the phase-change materials can be obtained directly by the refrigerant network wherein the refrigerant fluid (for example glycol) disposed under the slab circulates or by another separate refrigerant network.

According to another possible feature, the device comprises at least two layers:

- a first support layer intended to be covered with ice;
- a second layer comprising said phase-change material.

According to another possible feature, the first layer rests directly on said second layer.

It will be noted that "directly" denotes that the heat transfers between the first and second layers are not altered by an ancillary element, and therefore that the thermal conductivity is essentially based on the respective thermal conductivity values of the first and second layers.

According to another possible feature, said slab comprises a third layer, referred to as intermediate layer, separating the first layer from the second layer.

According to another possible feature, the third layer in turn comprises two levels:

- a first level which is made of a high-strength construction material, such as concrete, and which is traversed by tubes forming said refrigerant network;
- a second level made of a heat-conducting material, such as a metallic material, said second level being inserted between the second layer and the first level.

According to another possible feature, the refrigeration network comprises one or more tubes passing through said second layer and/or third layer.

According to another possible feature, said slab comprises a layer of thermal insulation.

According to another possible feature, the phase-change material has a melting point between −5° C. and −25° C., and preferably between −10° C. and −20° C.

According to another possible feature, the skating rink comprises photovoltaic panels intended to power said refrigeration device electrically.

According to another possible feature, said refrigerant fluid comprises glycol.

According to another possible feature, said skating rink comprises an electrical storage battery.

According to another possible feature, said building is thermally insulated, particularly via thermally insulating materials.

According to another possible feature, the refrigeration device is configured to be powered at least in part by said photovoltaic panels and/or by said storage battery.

According to another possible feature, the refrigeration device includes at least one operating mode wherein said refrigeration device only cools the air located above the slab covered with ice.

The pumps, compressors and other means of said refrigeration device make it possible to circulate the refrigerant fluid are therefore switched off to save energy, the phase-change material making it possible to keep the ice at a temperature below the melting point thereof.

Figure 2:
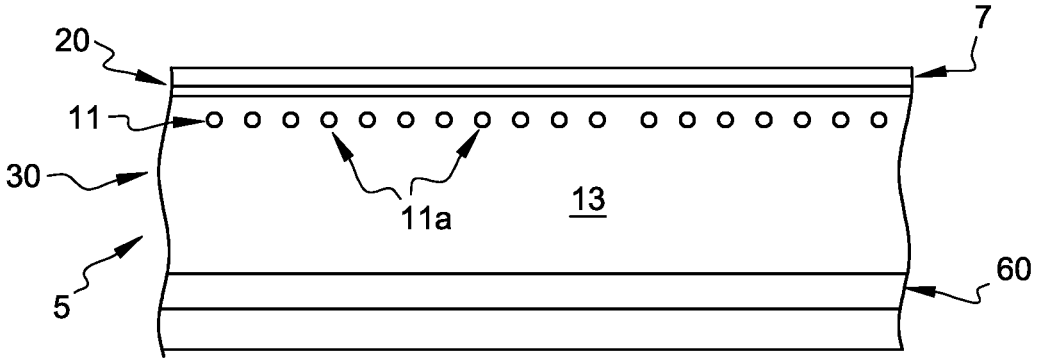
Figure 3:
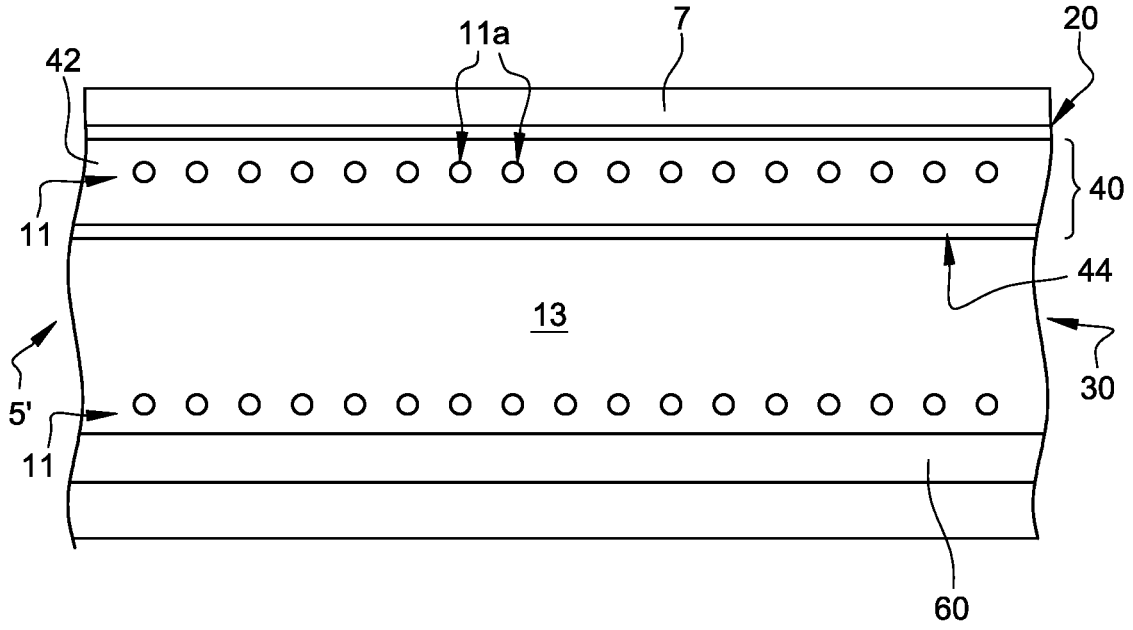

The invention will be better understood, and other aims, details, features and advantages thereof will appear more clearly throughout the following description of particular embodiments of the invention, given only for illustrative and non-limiting purposes, with reference to the accompanying drawings, wherein:

FIG. 1, referenced [FIG. 1], is a very schematic sectional representation of a skating rink according to the invention;

FIG. 2, referenced [FIG. 2], is a schematic sectional representation of a first embodiment, referred to as direct embodiment, of the slab of the skating rink in FIG. 1;

FIG. 3, referenced [FIG. 3], is a schematic sectional representation of a second embodiment, referred to as indirect embodiment, of the slab of the skating rink in FIG. 1.

FIG. 1 is thus a schematic sectional representation of a skating rink 1 according to the invention.

Said skating rink 1 is a covered artificial skating rink composed of a closed building 3 built over a slab 5 intended to be covered with ice 7.

Said skating rink 1 particularly comprises:

- a refrigeration device 9 connected to the refrigerant network 11 (more particularly seen in FIGS. 2 and 3) wherein a refrigerant fluid, such as glycol or glycol water, circulates;
- a phase-change material 13 connected to said refrigeration device 9 via said refrigerant network 11. More specifically and again with reference to FIGS. 2 and 3, the refrigerant network 11 is embedded in the phase-change material 13 thus providing the connection between said refrigerant material 13 and the refrigeration device 9.

Said phase-change material 13 is particularly configured to keep the ice covering the slab 5 at a temperature below the melting point of the ice, generally around 0° C. For this, said phase-change material 13 has a melting point between −5° C. and −25° C., and preferably between −10° C. and −20° C.

Said skating rink 1 advantageously comprises photovoltaic (or solar) panels 15 and an electrical energy storage battery. Said photovoltaic panels 15 are disposed on the roof of the building of the skating rink 1 or are integrated in a solar roof.

The refrigeration device 9 is for example a set of heat exchangers, pump(s), compressor(s), and tubes 11*a* of the refrigerant network 11 making it possible to carry out a thermodynamic cycle (such as a Carnot, Rankine cycle, etc.) wherein calories are exchanged between the interior and the exterior of the skating rink 1. The pump or the compressor of said refrigeration device 9 particularly circulates the refrigerant fluid in said heat exchangers and the tubes 11*a* of the refrigerant network 11.

More specifically, the refrigeration device 9 is configured to discharge calories outside the skating rink 1, so that the refrigerant fluid optimally captures the calories stored in the slab 5, particularly when said refrigerant fluid circulates in the tubes 11*a* located in the slab 5.

Said photovoltaic panels 15, for their part, can supply the different elements of the skating rink 1 consuming electrical energy, particularly the refrigeration device 9 and its sub-elements, with electricity. Furthermore, if the electrical production of the photovoltaic panels 15 is greater than the electricity consumption of the skating rink 1, a storage battery is configured to store the excess energy thus generated for subsequent use, for example at night when sunshine is lacking.

FIG. 2 is a schematic sectional view of a first embodiment of the slab 5 of a skating rink 1 according to the invention.

Said slab 5 thus comprises:

- a first support layer 20 intended to be covered with ice 7;
- a second layer 30 comprising said phase-change material 13.

This first embodiment is referred to as "direct embodiment", because the first layer 20 rests directly on the second layer 30, i.e. there are no intermediate layers between the first layer 20 and the second layer 30.

The second layer 30 comprises a thickness of phase-change material 13 and is traversed by tubes 11*a* of the refrigerant network 11.

The first layer 20, for its part, is made of a material adapted to be clamped between a layer of ice 7 and the second layer 30. "Adapted" material denotes a material having mechanical characteristics rendering it capable of withstanding (therefore without cracking and/or deforming) the stress exerted by the layer of ice 7 and the second layer 30, particularly volume variations due to thermal expansion of the layer of ice 7 and the second layer 30.

A layer of thermal insulation 60 is advantageously disposed below the second layer 30, in order to thermally insulate the support layer 20 and the layer of phase-change material 30 from the exterior of the skating rink 1 (and also from the primary floor).

FIG. 3 is a schematic sectional view of a second embodiment, referred to as "indirect embodiment", of the slab 5' of a skating rink 1 according to the invention.

It will be noted that the identical or similar elements thus bear the same references as in the figures of the previous embodiments and will therefore not be detailed again.

Thus, said slab 5' comprises:

- a first support layer 20 intended to be covered with a layer of ice 7;
- a second layer 30 comprising said phase-change material 13;
- a third layer 40, referred to as intermediate layer, separating the first layer 20 from the second layer 30.

More specifically, said third layer 40 itself comprises two levels 42 and 44:

a first level 42 which is made of a high-strength construction material, such as concrete, and which is traversed by tubes 11*a* of said refrigerant network 11;

a second level 44 made of a heat-conducting material, such as a metallic material, for example aluminium.

Said second level 44 is inserted between the second layer 30 and the first level 42, in order to physically separate the first level 42 from the phase-change material 13.

As above, tubes 11*a* forming the refrigerant network 11 pass through the second layer 30, i.e. said tubes 11*a* are embedded in the phase-change material 13. Furthermore, tubes 11*a* forming the network 11 also pass through the third layer 40. The tubes 11*a* are advantageously configured so that the refrigerant fluid, transported through these tubes 11*a*, first flows through the second layer 30, then through the third layer 40 (the aim being to cool the fluid before it passes through the third layer).

Regardless of the embodiment of the slab 5, 5', the building of the skating rink 1 is closed and thermally insulated, for example by means of a heat-insulating material.

Advantageously, the refrigeration device 9 comprises an air-conditioning system configured to cool the air located above the slab 5, 5' of the skating rink 1.

Furthermore, the refrigeration device 9 is configured to have at least two operating modes:

a first operating mode, referred to as "day mode", wherein excess calories are stored and/or dissipated in the phase-change material 13 and/or by the heat exchangers of said refrigeration device 9;

a second operating mode, referred to as "night mode", wherein the air located above the slab 5, 5' is optimally cooled via the air conditioning system and wherein the frigories contained in the phase-change material 13 make it possible to keep the ice covering said slab 5, 5' at a temperature less than the melting point thereof.

When the second operating mode is implemented, the pump(s) and compressors of said refrigeration device 9 are shut down, to minimise the electrical consumption of the skating rink.

Thus, "night mode" makes it possible to store frigories in the phase-change material 13. The frigories thus stored can be used subsequently, for example in the daytime, when there are skaters on the slab 5, 5' and it is not possible to sufficiently cool the air above the layer of ice intended for skating.

What is claimed is:

1. An artificial skating rink comprising:

a slab comprising:

a first layer that supports a layer of ice covering the slab, wherein the first layer is made of a material having mechanical characteristics such that the material withstands stress exerted by the layer of ice without cracking;

a second layer comprising a thickness of phase-change material and a first refrigerant network of multiple tubes disposed through the phase-change material, wherein the first layer is positioned on top of the second layer; and an intermediate layer comprising another material and a second refrigerant network of multiple tubes disposed through the another material, wherein the multiple tubes of the first refrigerant network are connected with the multiple tubes of the second refrigerant network, and wherein the intermediate layer is positioned between the first layer and the second layer; and a refrigeration device connected to the first refrigerant network wherein a refrigerant fluid circulates within the first refrigerant network and the second refrigerant network;

wherein the refrigerant fluid is provided by said refrigeration device;

wherein the phase-change material keeps the ice covering the slab at a temperature below the melting point of the ice by the circulation of the refrigerant fluid via the first network.

2. The artificial skating rink according to claim 1, wherein the slab comprises:

a third layer comprising thermal insulation material, wherein the third layer is disposed below the second layer.

3. The artificial skating rink according to claim 2, further comprising:

a heat conducting layer comprising a heat conducting material, wherein the heat conducting layer is positioned directly below the intermediate layer and above the second layer comprising the phase-change material.

4. The artificial skating rink according to claim 1, wherein the first layer rests directly on said intermediate layer.

5. The artificial skating rink according to claim 1, wherein the first refrigerant network and the second refrigerant network are connected such that the refrigerant fluid first flows through the first refrigerant network and then flows through the second refrigerant network, the refrigerant fluid comprising glycol.

6. The artificial skating rink according to claim 1, wherein the refrigeration device comprises a plurality of heat exchangers, a plurality of pumps and a plurality of compressors that cause the refrigerant fluid to circulate through the first refrigerant network and the second refrigerant network.

7. The artificial skating rink according to claim 6, wherein the skating rink comprises photovoltaic panels intended to power said refrigeration device electrically.

8. The artificial skating rink according to claim 6, characterized in that it comprises an electrical storage battery.

9. The artificial skating rink according to claim 6, wherein the refrigeration device is configured to be powered at least in part by a plurality of photovoltaic panels and/or by a storage battery.

10. The artificial skating rink according to claim 1, wherein the phase-change material has a melting point between −10° C. and −25° C.

11. An artificial skating rink comprising:

a slab comprising:

first layer that supports ice covering the slab; and a second layer comprising a first refrigerant network of multiple tubes disposed through a phase-change material;

an intermediate layer comprising a heat conducting material comprising a metallic material and a construction material comprising concrete layered above the heat conducting material, wherein the intermediate layer is positioned between the first layer and the second layer comprising the phase-change material, wherein the intermediate layer comprises a second refrigerant network of multiple tubes disposed in the concrete; and a third layer comprising thermal insulation material, wherein the third layer is disposed below the intermediate layer; and a refrigeration device connected to the first refrigerant network wherein a refrigerant fluid circulates within the first refrigerant network and the second refrigerant network;

wherein the refrigerant fluid is provided by said refrigeration device; and wherein the phase-change material keeps the ice covering the slab at a temperature below the melting point of the ice by the circulation of the refrigerant fluid via the first network.

12. The artificial skating rink of claim 11, wherein the first refrigerant network and the second refrigerant network are connected such that the refrigerant fluid first flows through the second refrigerant network and then flows through the first refrigerant network.

13. The artificial skating rink of claim 12, wherein the refrigeration device comprises a plurality of heat exchangers, a plurality of pumps and a plurality of compressors that cause the refrigerant fluid to circulate through first through the second refrigerant network and then through the first refrigerant network.

* * * * *